US006272800B1

(12) United States Patent
Phinney et al.

(10) Patent No.: US 6,272,800 B1
(45) Date of Patent: Aug. 14, 2001

(54) PROTECTION DEVICE FOR ROOF AND FLOOR OPENINGS

(75) Inventors: Peter R. Phinney, 1130 Mudbrook Rd., Huron, OH (US) 44839; Timothy L. Ahner, Sandusky, OH (US)

(73) Assignee: Peter R. Phinney, Huron, OH (US)

( * ) Notice: Subject to any disclaimer, the term of this patent is extended or adjusted under 35 U.S.C. 154(b) by 0 days.

(21) Appl. No.: 09/688,888

(22) Filed: Oct. 16, 2000

(51) Int. Cl.[7] ..... E04B 7/18

(52) U.S. Cl. ..... 52/200; 52/202; 52/20; 52/DIG. 12; 49/57; 49/50; 256/DIG. 6; 182/112; 182/113

(58) Field of Search ..... 52/200, 20, 202, 52/DIG. 12; 49/50, 57; 256/DIG. 6; 182/112, 113; 160/369, 371, 372

(56) References Cited

U.S. PATENT DOCUMENTS

D. 354,817 1/1995 Kovacs et al. .
4,520,898 * 6/1985 Allemane ..... 182/113
5,295,557 3/1994 Taylor .
5,502,934 4/1996 Coyne et al. .
5,676,350 10/1997 Galli et al. .
5,941,024 8/1999 Journault .
6,009,929 * 1/2000 Linderman et al. ..... 52/202

* cited by examiner

*Primary Examiner*—Beth A. Stephan
*Assistant Examiner*—Dennis L. Dorsey
(74) *Attorney, Agent, or Firm*—Pearne & Gordon LLP

(57) ABSTRACT

A protective device is provided to prevent humans from accidentally falling through openings in roofs or floors, including the domes of curb-mounted skylights and temporary utility chases that are surrounded by a raised curb. The protective device is secured to the raised curb by clamps that do not penetrate the curb, skylight frame, floor or roof, and therefore do not compromise the water-tight integrity thereof. In the case of an opening type skylight, by securing the protective device to the curb, no interference is contributed to the skylight to hinder the opening mechanism of the skylight.

24 Claims, 3 Drawing Sheets

FIG. 1
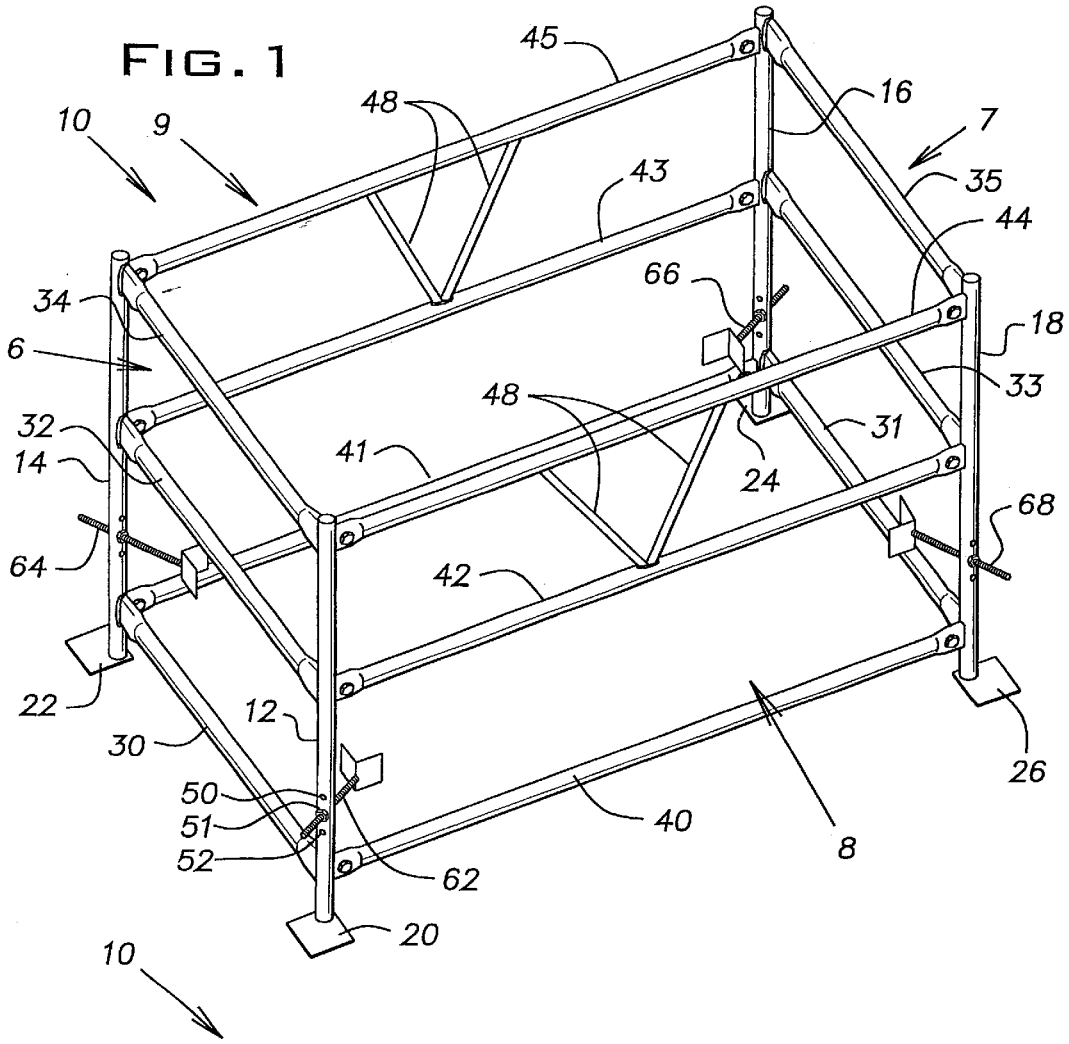
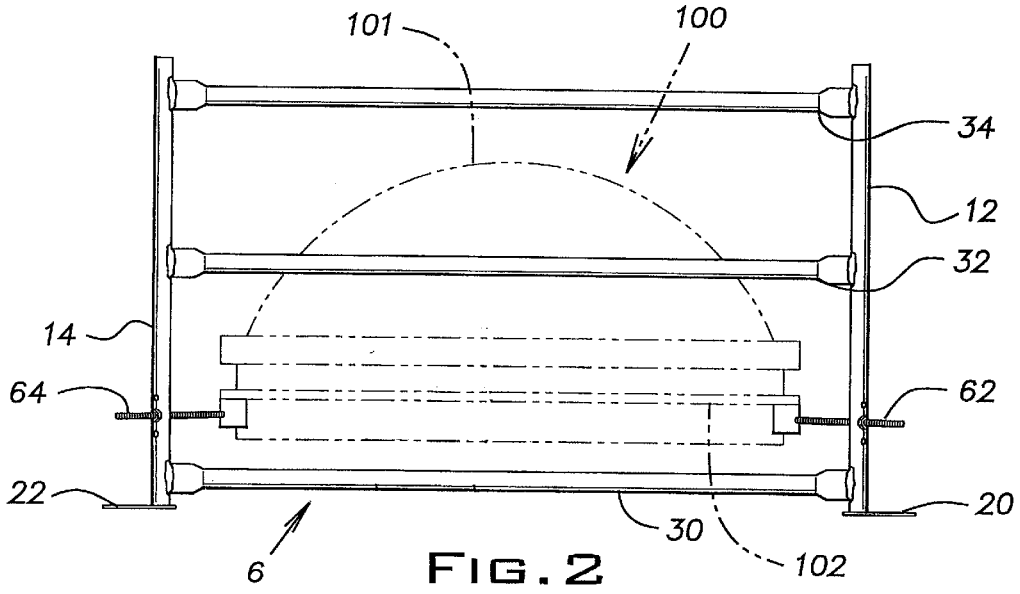
FIG. 2

FIG. 5
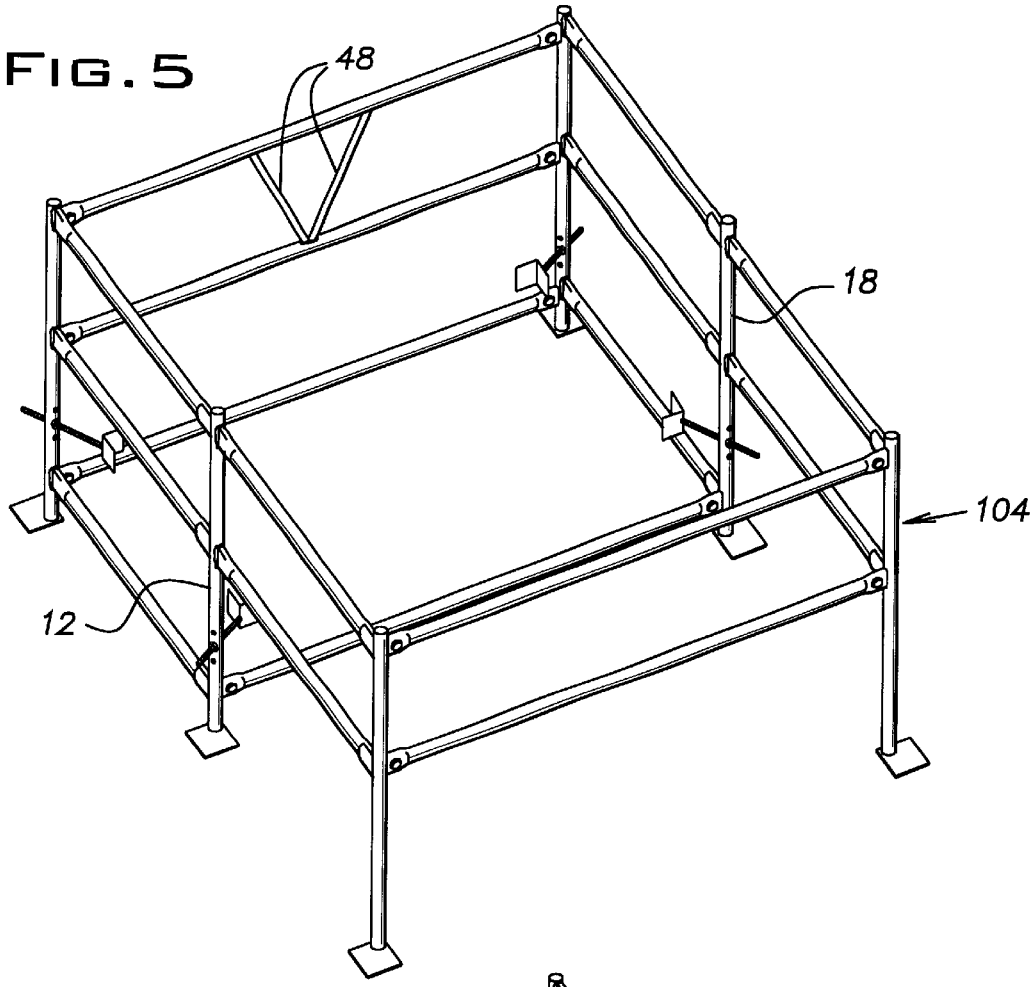
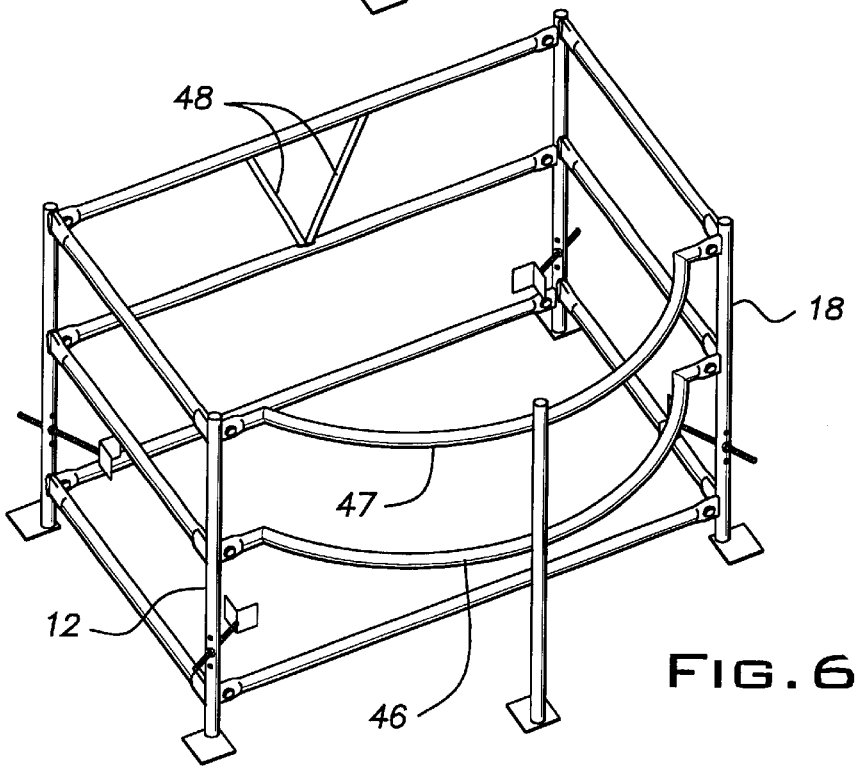
FIG. 6

PROTECTION DEVICE FOR ROOF AND FLOOR OPENINGS

BACKGROUND OF THE INVENTION

The present invention relates to a protective device and more particularly to a protective device for roof and floor openings that are surrounded by a raised curb. The invention is installed to prevent a human from accidentally falling through such an opening to the floor below.

Domed skylights are a particular type of roof opening that present a constant danger to roof and utility workers working on flat roofs. The domes cannot support the weight or impact force of a fallen human, and thus have been the cause of many deaths and serious injuries due to collapse and breakage upon impact, sending the fallen human crashing to the floor below.

The Occupational Safety and Health Administration (OSHA) has promulgated regulations specifically requiring employers to provide fall protection to workers. Current OSHA regulations require "each employee on walking/working surfaces shall be protected from falling through holes (including skylights) more than 6 feet (1.8 m) above lower levels, by personal fall arrest systems, covers, or guardrail systems erected around such holes." (29 C.F.R. § 1926.501(b)(4)(i) (1999)).

Existing skylight fall protection devices generally comprise a skylight cover or metal screening system extending over the domed skylight. The cover or screening is typically fixed to the skylight frame via bolted connections, essentially becoming part of the skylight frame. (See, e.g., U.S. Pat. No. 5,502,934). Such protective means have a negative effect upon the operation of opening type skylights because their excess weight can hinder the spring-loaded mechanism that opens the skylight. Even absent the negative effect of their weight, cover and screening type protective devices often prevent the skylight from opening by blocking the opening path of the skylight dome. In addition, the bolted attachment means of prior art protective devices impair the water-tight integrity of the skylight frame or the roof creating portals through which water may enter. The attachment of these prior art protective devices may in some or many cases negate certification which the skylight had previously obtained.

Utility chases commonly found in the floors of high-rise buildings and skyscrapers under construction present a second formidable danger to proximal workers. Typically, utility chases are surrounded only by a raised curb which is not effective to prevent workers from falling through the chase to the floor below.

There is a need in the art for an effective floor or roof opening protective device that does not hinder the spring-loaded mechanisms of opening skylights, detract from the water tight integrity of the mounting surface (i.e. curb, skylight frame, roof or floor), or block the opening path of a domed skylight.

SUMMARY OF THE INVENTION

A protective device is provided for an opening in a roof or floor that is surrounded by a raised curb. The protective device has a perimeter barrier wall adapted to surround the opening and is effective in preventing a human from traversing therethrough. Clamps are connected to the barrier wall, the clamps being capable of effectively clamping the barrier wall to the raised curb without penetrating the curb, floor or roof.

BRIEF DESCRIPTION OF THE DRAWINGS

FIG. 1 is a perspective view of a first preferred embodiment of a protective device of the present invention.

FIG. 2 is a side elevational view of the preferred embodiment of the present invention shown in FIG. 1.

FIG. 5 is a perspective view of a second preferred embodiment of a protective device of the present invention designed to accommodate opening type skylights.

FIG. 6 is a perspective view of a third preferred embodiment of a protective device of the present invention designed to accommodate opening type skylights.

DETAILED DESCRIPTION OF THE PREFERRED EMBODIMENTS

A protective device 10 is provided having clamping means for rigidly securing the protective device 10 to a curb surrounding a roof or floor opening. As used herein, "curb" means a raised barrier, typically concrete though other suitable materials can be used, projecting upward at least 1, 2, 3, 4, 5, or 6 inches from a floor or roof and surrounding an opening therein.

Figure 3:
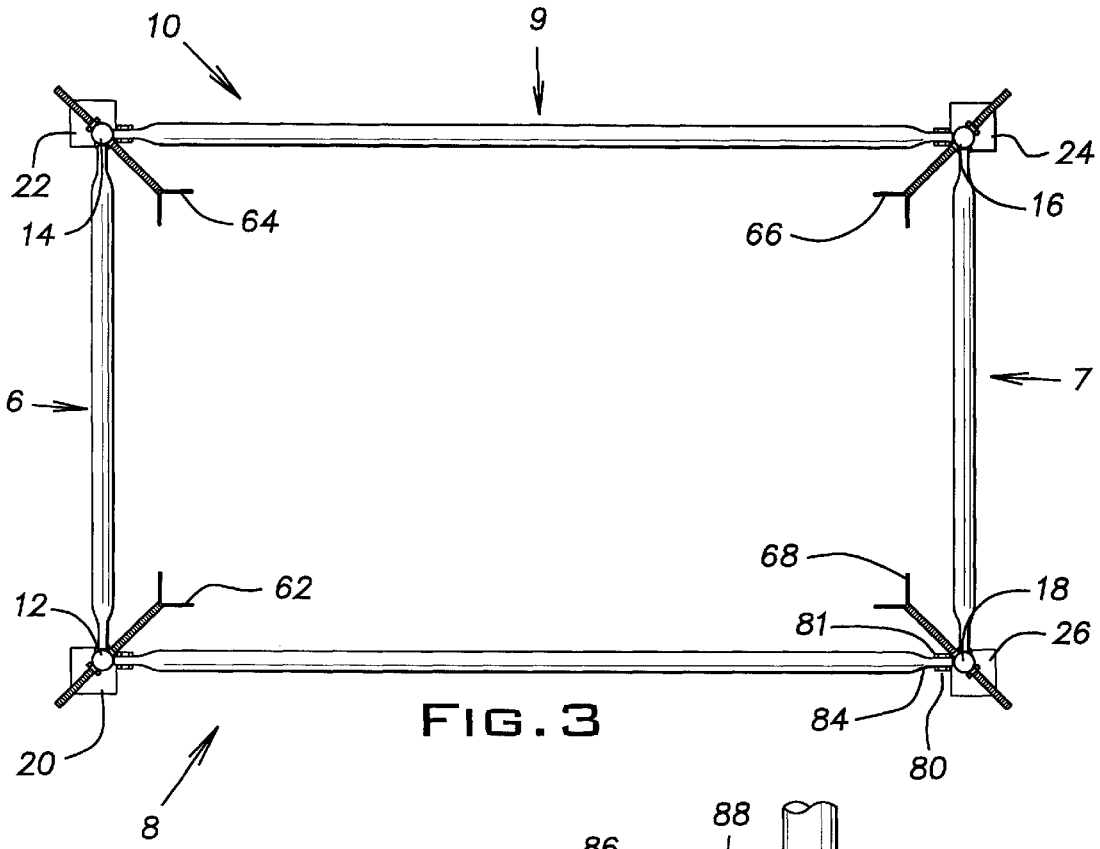
FIG. 3 is a top view of the preferred embodiment of the present invention shown in FIG. 1.

Referring to FIGS. 1 and 2, a preferred embodiment of a protective device 10 according to the invention is shown having a first short wall 6, a second short wall 7, a first long wall 8, and a second long wall 9, with all four walls forming a perimeter barrier wall that completely surrounds an opening in a floor or roof and is effective to prevent a human from progressing therethrough and accidentally falling through the enclosed opening. The perimeter barrier wall has a rectangular projection when viewed from above as best seen in FIG. 3. Less preferably, the perimeter barrier wall can have a projection of some other shape when viewed from above, for example circular, elliptical, trapezoidal, pentagonal, hexagonal, or any other closed polygon configuration.

Though the walls that form the perimeter barrier wall of the protective device 10 are described below as comprising rails and cross-braces attached to vertical support members in accordance with the most preferred embodiments of the invention, less preferably the walls may comprise plywood, sheet metal (such as aluminum, steel, etc.), netting (cloth, plastic, rubber, or any other suitable material), or any other suitable barrier means.

Most preferably, vertical support members 12, 14, 16, 18 are disposed at the intersections of the short walls 6, 7 with the long walls 8, 9 forming the corners of the protective device 10. Each vertical support member 12, 14, 16, 18 has a roof or surface pad 20, 22, 24, 26 at its base. Preferably, each roof pad 20, 22, 24, 26 has rounded corners and an upward slanted hem or flange along each edge to minimize point loading and to prevent the pad digging in to the roof surface. The vertical support members 12, 14, 16, 18 are connected along the first and second short sides 6 and 7 respectively by first and second short base rails 30 and 31, first and second short middle rails 32 and 33, and first and second short upper rails 34 and 35. Similarly, the vertical support members 12, 14, 16, 18 are connected along the first and second long walls 8 and 9 respectively by first and second long base rails 40 and 41, first and second long middle rails 42 and 43, and first and second long upper rails 44 and 45.

Most preferably, the first and second long base rails 40, 41 and the first and second short base rails 30, 31 are attached to their respective vertical support members near the bases thereof as shown in FIGS. 1–2 so as not to obstruct access to the inner clamping nut 76 of the clamps or clamp assemblies 62, 64, 66, 68 as described below. Less preferably, the first and second long base rails 40, 41 and first and second short base rails 30, 31 can be attached to their respective vertical support members some distance above the point of attachment of the clamps or clamp assemblies 62, 64, 66, 68. Cross braces 48 may optionally be provided to impart rigidity and stability to the protective device 10. The cross braces 48 shown in FIGS. 1, 2, 5 and 6 are of a generally V-shaped configuration, though cross braces of any suitable configuration may be used.

Figure 4:
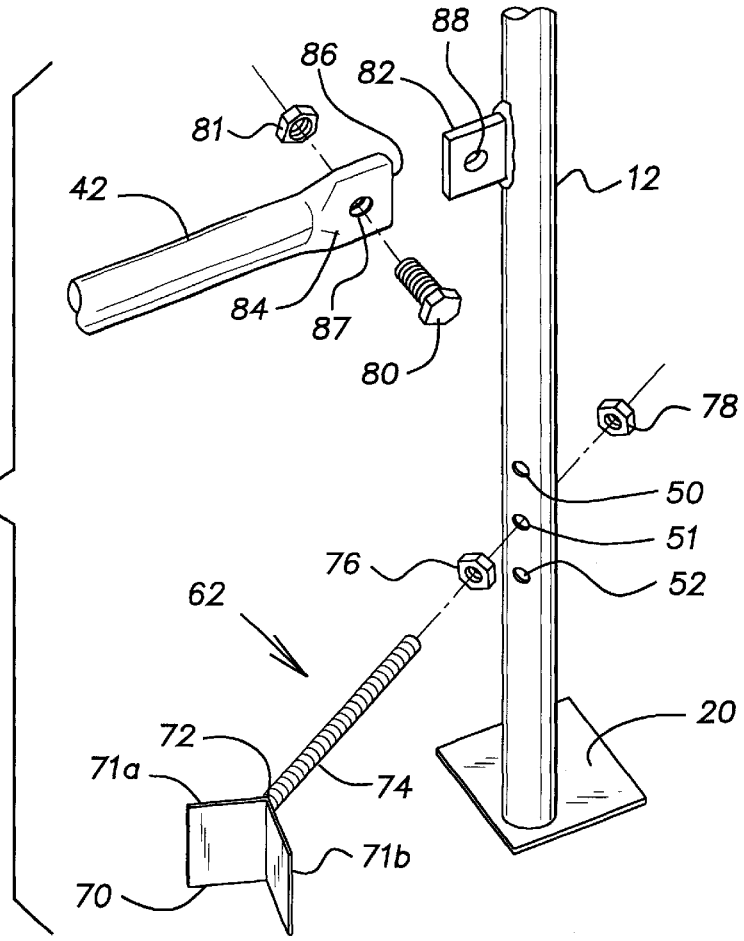
FIG. 4 is a close-up perspective view of a vertical support member showing preferred embodiments both of a clamping means, and of a detachable connection means for attaching long rails to adjacent vertical support members according to the present invention.

In the most preferred embodiment of the invention, and as can best be seen in FIGS. 3 and 4, each of the long rails (long base rails 40, 41, long middle rails 42, 43, and long upper rails 44, 45) is removably attached to the vertical support members 12, 14, 16, 18 at either end by means of a bolt 80 and a nut 81. Most preferably, each long rail has a crimped end 84 at the point of attachment to a vertical support member 12, 14, 16, 18, with space left between the compressed sides of the crimped end 84 thus forming a tab socket 86 therein. The crimped end 84 has a first bolt hole 87 to accommodate a bolt 80 or other securing means. Each vertical support member 12, 14, 16, 18 has a tab 82 securely fastened thereto at the point of attachment of an adjacent long rail, the tab 82 having a second bolt hole 88 to accommodate a bolt 80 or other securing means.

When the protective device 10 is fully assembled, a tab 82 attached to a vertical support member 12, 14, 16, 18 fits snugly inside the tab socket 86 at a crimped end 84 of an adjacent long rail, and a bolt 80 and nut 81 rigidly secure the tab 82 within the tab socket 86. Alternatively, crimped ends 84 can be provided without tab sockets 86, wherein a tab 82 attached to a vertical support member 12, 14, 16, 18 is rigidly secured adjacent to and outside of a crimped end 84 of an adjacent long rail via a bolt 80 and a nut 81; similarly an L-shaped clip or bracket can be attached via welding to the end of the long rail, with the bottom of the L perpendicular to the longitudinal axis of the long rail and the upper part of the L extending parallel to tab 82, but on one side or the other of the tab 82, with a hole in the upper part of the L so that the L-shaped clip can be bolted to tab 82. This rigid but separable construction facilitates ease of packaging and shipping of the protective device 10 which is cumbersome to transport when fully assembled. Additionally, separable construction facilitates interchangeability of long rails having variable lengths to accommodate floor or roof openings (such as domed curb-mounted skylights 100) of standard width but varying length. Least preferably, the long rails can be welded or attached to the vertical support members 12, 14, 16, 18 via other means known in the art.

Referring to FIG. 4, the following description of the novel clamping means of the present invention is provided and the figure contains reference numerals with respect to the vertical support member 12 and its associated clamp or clamp assembly 62. However, it will be understood that each of the three remaining vertical support members 14, 16, 18 and respective clamps or clamp assemblies 64, 66, 68 are provided similarly as pictured in FIG. 4 and as described herein. A plurality of adjustment holes (preferably or at least three) 50, 51, 52 are provided in a vertical support member 12 and are spaced from each other and from the roof pad 20 preferably by no more than 2.5, more preferably 2.0, more preferably 1.5, more preferably 1.0 inches. A clamp or clamp assembly 62 is provided comprising a clamp angle 70 having a first clamp face 71*a* and a second clamp face 71*b* wherein the first and second clamp faces meet along a clamp edge 72, a threaded rod 74 rigidly attached to and projecting outwardly from the clamp edge, and an inner clamping nut 76. The clamp assembly 62 may optionally be provided with an outer nut 78 that is preferably removed when the protective device 10 is in use.

Once in place around a domed curb-mounted skylight 100 the protective device 10 is fixed in place by means of the clamp assemblies 62, 64, 66, 68 provided respectively on the vertical support members 12, 14, 16, 18. The clamp angle 70 is compressed against the curb 102 of a domed curb-mounted skylight 100 by means of the inner clamping nut 76 and the threaded rod 74. Clamping pressure is generated by tightening the inner clamping nut 76 in the direction of the vertical support member 12. Because the inner clamping nut 76 is advantageously constrained against the vertical support member 12, the threaded rod 74 is displaced inward from the vertical support member 12 along its longitudinal axis as the inner clamping nut 76 is tightened, thus compressing the clamp angle 70 against the curb 102. It will be understood by one skilled in the art that by compressing the clamp angles 70 of all four clamp assemblies 62, 64, 66, 68 against the curb 102 of the domed curb-mounted skylight 100, the protective device is held rigidly in place against the curb 102. Optionally, the clamp faces of the clamp angles 70 can be provided with a resilient padded liner to prevent damage to the curb 102 from the force of the clamping pressure exerted by the clamp angles 70 against the curb. The resilient liner may be comprised of rubber, foam rubber, cork, wood, or any other suitable material.

The clamp assemblies 62, 64, 66, 68 are provided with sufficient clamping strength to withstand, with no displacement of the protective device 10 relative to the curb 102, the impact force of a fallen human weighing 100, more preferably 120, more preferably 140, more preferably 160, more preferably 200, more preferably 250, more preferably 300, more preferably 400 pounds. Further, the clamp assemblies 62, 64, 66, 68, are provided with sufficient clamping strength to prevent displacement of the protective device 10 relative to the curb 102 due to a sustained wind having a velocity of 30, more preferably 40, more preferably 50, more preferably 70, more preferably 100, more preferably 150, more preferably 200 miles per hour.

A protective device 10 secured to the curb 102 of a domed curb-mounted skylight 100 by means of clamp assemblies 62, 64, 66, 68 in the above described manner does not detract from the water tight integrity of either the roof or the skylight frame because no bolts are used and hence no holes are required. Further, by securing the protective device 10 to the curb 102 and not to the frame of an opening type skylight, the spring-loaded opening mechanism is not negatively affected because no weight is contributed to the frame of the opening type skylight. In addition, the roof pads 20 prevent point loading on the roof via the vertical support members 12, 14, 16, 18 that would otherwise result from the impact force of a fallen human against the protective device 10. For these reasons, a protective device according to the present invention neither invalidates the F.M. or U.L. rating of a skylight, nor deleteriously effects the structural integrity of a roof.

In a second preferred embodiment of the invention, the protective device 10 comprises means to further accommodate opening type skylights by eliminating obstructions in the opening path of the skylight dome 101. FIG. 5 shows one embodiment of an accommodating means according to the present invention. The protective device 10 is provided similarly as described with respect to other preferred embodiments above, with two principal differences: the first long middle rail 42 and first long upper rail 44 are missing therefrom in order to accommodate the dome 101 of an opening type skylight in the open position; and the protective device 10 further comprises a dome cage portion 104. The dome cage portion 104 is comprised of vertical support members and long and short rails similarly as the protective device 10, effectively doubling the width of the protective device 10. Preferably, the dome cage portion 104 is removably attached to the vertical support members 12, 18 for ease of packaging and shipping, and most preferably the dome cage portion 104 is itself further collapsible by means of tabs 82 and tab sockets 86 in similar fashion as the most preferred embodiment of the invention described above.

A second accommodating means for opening type skylights according to the present invention is shown in FIG. 6. In this embodiment, the first long middle and first long upper rails, 42 and 44, are replaced respectively with a middle curved rail 46 and an upper curved rail 47 which form a bulge. Preferably, the middle and upper curved rails, 46 and 47, have crimped ends 84 enclosing tab sockets 86, and are removably attached to the vertical support members 12,18 in similar fashion as described above with respect to the long rails according to the most preferred embodiment of the invention.

In addition to curb-mounted skylights 100, the protective device 10 of the present invention can also be used to protect humans from falling through utility chases commonly found in the floors of high-rise buildings and skyscrapers during construction. Such temporary openings are necessary for the installation of water pipes, electrical conduits, and other utilities. However, such openings present a formidable hard to construction workers because they are often unguarded except by a cement curb intended to prevent water seepage to the floors below. A protective device 10 according to the present invention can be installed to guard against accidental falls through such temporary openings.

Although the hereinabove described embodiments of the invention constitute the preferred embodiments, it should be understood that modifications can be made thereto without departing from the scope of the invention as set forth in the appended claims. For instance, the long rails can be permanently and irremovably attached to the vertical support members via welded connections or some other known means. Detachable connections are merely preferred, not required within the scope of the invention.

What is claimed is:

1. A protective device for an opening in a roof or floor that is surrounded by a raised curb, said protective device comprising:

a perimeter barrier wall adapted to surround said opening and being effective to prevent a human from traversing therethrough, and a plurality of clamps connected to said barrier wall, said plurality of clamps being adapted to clamp said barrier wall to said curb without penetrating said curb, roof or floor, each of said clamps being extendable from (a) a first position in which said clamp is spaced apart from said curb to (b) a second position in which said clamp compressively engages said curb, each of said clamps extending in a generally horizontal direction when it extends from said first position to said second position.

2. A protective device according to claim 1, wherein each of said clamps comprises a clamp assembly attached to said perimeter barrier wall, said clamp assembly comprising a clamp angle having a first clamp face and a second clamp face.

3. A protective device according to claim 2, wherein said first and second clamp faces form a clamp edge of said clamp angle, said barrier wall being supported by a plurality of vertical support members, said clamp assembly further comprising a threaded rod which extends through a vertical support member.

4. A protective device according to claim 2, wherein a resilient padding material is disposed on the inner surface of said clamp angle.

5. A protective device according to claim 1, wherein said clamps exert sufficient clamping pressure to sustain the impact force of a fallen human weighing 100 pounds with no substantial displacement of said protective device relative to said curb.

6. A protective device according to claim 1, wherein said perimeter barrier wall comprises a plurality of vertical support members spaced from each other and adapted to be disposed about the exterior perimeter of said curb.

7. A protective device according to claim 6, further comprising rails attached to and connecting adjacent vertical support members.

8. A protective device according to claim 6, wherein each of said vertical support members has a surface pad disposed at its base.

9. A protective device according to claim 7, wherein each of said rails is removably attached to said adjacent vertical support members.

10. A protective device according to claim 7, wherein cross braces are disposed between and attached to adjacent rails to provide additional structural reinforcement.

11. A protective device according to claim 7, wherein each of said vertical support members has attached thereto near the base thereof one of said clamps, each of said clamps including a threaded rod passing through said vertical support member, said threaded rod having a nut thereon.

12. A protective device according to claim 11, wherein at least one of said vertical support members has a plurality of holes therethrough, each hole adapted to accommodate said threaded rod at a different height above the bottom of said vertical support member.

13. A protective device according to claim 1, adapted to accommodate a utility chase present in a floor of a building.

14. A protective device according to claim 1, adapted to accommodate an opening underneath a curb-mounted skylight on the roof of a building.

15. A protective device according to claim 14, adapted to accommodate an opening underneath a non-opening curb-mounted skylight.

16. A protective device according to claim 14, wherein said curb-mounted skylight is operable and of the opening type, said protective device further comprising:

means for accommodating a dome of said opening type curb-mounted skylight in the open position.

17. A protective device according to claim 16, wherein said accommodating means comprise a dome cage having a perimeter barrier wall forming an extension of said protective device, thereby enclosing additional roof space adjacent to said opening type curb-mounted skylight to prevent a human from proceeding in the opening path of said dome, thus allowing said dome to proceed unencumbered between said closed and open positions within said additional enclosed roof space.

18. A protective device according to claim 16, wherein said accommodating means comprise a curved rail which is bulged outwardly to provide an accommodating space for the open position of an opening type skylight.

19. A protective device according to claim 1, said plurality of clamps including a first clamp and a second clamp, said first clamp adapted to apply a compressive force in a first direction, said second clamp adapted to apply a compressive force in a second direction which is substantially nonparallel to said first direction.

20. A protective device according to claim 1, said barrier wall being substantially rectangular in top view, a clamp in each corner of the rectangular barrier wall adapted to apply a compressive force directed generally toward the central portion of the protective device.

21. A protective device according to claim 1, said barrier wall being substantially rectangular in top view, a clamp in each corner of the rectangular barrier wall adapted to apply a compressive force directed angularly away from the two adjacent portions of said barrier wall which form said corner.

22. A protective device according to claim 1, wherein each of said clamps comprises a clamp assembly, said clamp assembly comprising a threaded rod.

23. A protective device according to claim 1, wherein said plurality of clamps is four separate clamps, and wherein each of said four clamps is independently extendable to compressively engage a corner of said curb.

24. A protective device according to claim 23 for an opening that is surrounded by a curb that has at least four corners, each corner of said curb being defined by a pair of sidewalls which meet to form a vertical corner edge, wherein each of said four clamps has a clamp angle formed by a first clamp face and a second clamp face, said first and second clamp faces forming a clamp edge, each of said four clamps being adapted to extend and engage a corner of said curb with said clamp edge lining up with a corresponding vertical corner edge.

* * * * *